US005356442A

United States Patent [19]

Ouziel et al.

[11] Patent Number: 5,356,442

[45] Date of Patent: Oct. 18, 1994

[54] METHOD FOR DYEING FIBROUS MATERIALS MADE OF OR CONTAINING WOOL

[75] Inventors: Philippe Ouziel, Riedisheim, France; Martin Kuhn, Dornach, Switzerland

[73] Assignee: Ciba-Geigy Corporation, Ardsley, N.Y.

[21] Appl. No.: 99,872

[22] Filed: Jul. 30, 1993

[30] Foreign Application Priority Data

Aug. 6, 1992 [CH] Switzerland ..... 2463/92

[51] Int. Cl.[5] ..... C09B 67/00; D06P 1/52

[52] U.S. Cl. ..... 8/552; 8/557; 8/582; 8/594; 8/598; 8/599; 8/601

[58] Field of Search ..... 8/552, 557, 558, 561, 8/582, 594, 598, 599, 601, 611, 612, 614, 128.1

[56] References Cited

U.S. PATENT DOCUMENTS

| | | | |
|---|---|---|---|
| 4,639,325 | 1/1987 | Valenty et al. | 252/89.1 |
| 4,983,315 | 1/1991 | Glogawaki et al. | 252/102 |
| 5,073,293 | 12/1991 | DeGuchi et al. | 252/174.17 |
| 5,077,039 | 12/1991 | Baur et al. | 536/18.6 |
| 5,179,201 | 1/1993 | Ofting et al. | 536/41 |

FOREIGN PATENT DOCUMENTS

| | | |
|---|---|---|
| 457155 | 11/1991 | European Pat. Off. . |
| 1619662 | 4/1969 | Fed. Rep. of Germany . |
| 1619004 | 11/1969 | Fed. Rep. of Germany . |
| 2439155 | 2/1975 | Fed. Rep. of Germany . |
| 2424892 | 12/1975 | Fed. Rep. of Germany . |
| 4014202 | 11/1991 | Fed. Rep. of Germany . |
| 2240950 | 3/1975 | France . |

OTHER PUBLICATIONS

Chem. Abst. 116:108875g (1991).
Chem. Abst. 85:65187r (1975).
Chem. Abst. 116: 131659h (1990).
Derw. Abst 91-333650/46 of DE 4,014,202 (1912).
Chem Abst. 116(12):108845q of DE 4,014,202 (1945).
Derw. Abstr. 75-16402w/10 of DE 2,439,155 (1935).
Chem. Abst. 85(10):65187r of DE 2,439,155 (1985).
Chem. Abstr. vol. 71 (1969) 295815 of DE 1,619,004.
Chem. Abst. vol. 73 (1970) 16202k of DE 1,619,662.
Textiles vol. 84 (1976) 152051q of DT 2,424,892.
Derw. Abst. 91-341606/47 of EP 457,155 (1991).

*Primary Examiner*—Arthur C. Prescott
*Attorney, Agent, or Firm*—George R. Dohmann

[57] ABSTRACT

A method is described for dyeing fibrous materials made of or containing wool with anionic dyes, which comprises dyeing these materials in the presence of a wool preservative comprising at least one compound of the formula $$R—CH_2—CH(OH)—CH_2—Y \quad (I),$$

where the variables are as defined in the claims. Rub-fast level dyeings are obtainable without deterioration in the quality of the wool.

18 Claims, No Drawings

METHOD FOR DYEING FIBROUS MATERIALS MADE OF OR CONTAINING WOOL

The present invention relates to a novel method for the high temperature dyeing of wool or fibrous materials containing wool.

It is known to dye wool or fibrous materials containing wool in the presence of assistants in order in this way to counteract fibre damage which arises in particular in high temperature dyeing. Many of the known assistants contain formaldehyde or release formaldehyde on heating, which is toxicologically undesirable.

There has now surprisingly been found an improved method for high temperature dyeing of fibrous materials made of or containing wool that is based on the use of a novel class of wool preservatives.

The present invention accordingly provides a method for dyeing fibrous materials made of or containing wool with anionic dyes, which comprises dyeing these materials in the presence of a wool preservative comprising at least one compound of the formula $$R—CH_2—CH(OH)—CH_2—Y \quad (I),$$

where

Y is halogen, R is hydroxy or a radical R*—C(O)—O—, and

R* is (Ia) the radical of an ethylenically unsaturated mono-, di- or tricarboxylic acid, in which in the case of a di- or tricarboxylic acid the remaining carboxyl group or groups may be partly or wholly esterified with a compound of the formula $$HO—CH_2—CH(OH)—CH_2—Y \quad (II)$$

and Y is as defined above, (Ib) the radical of a homo- or copolymer of ethylenically unsaturated mono-, di- or tricarboxylic acid derivatives with or without one or more comonomers, in which the carboxyl groups are wholly or partly esterified with a compound of the above-indicated formula (II), (Ic) the radical of a carboxyl-containing modified sugar derivative, in which, if it has more than one carboxyl group, the remaining carboxyl group or groups may be esterified with a compound of the above-indicated formula (II), or (Id) the radical of a saturated mono-, di-, tri-, tetra- or pentacarboxylic acid, in which in the case of a di-, tri-, tetra- or pentacarboxylic acid the remaining carboxyl group or groups may be wholly or partly esterified with a compound of the above-indicated formula (II).

Y is for example bromine and preferably chlorine.

When R is R*—C(O)—O— and R* is the radical of an ethylenically unsaturated mono-, di- or tricarboxylic acid as per (Ia), the compound used according to the invention may have for example the formula

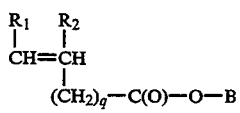

(1)

where $R_1$ and $R_2$ are independently of each other for example hydrogen, hydroxyl, halogen, alkyl or a group $—(CH_2)_p—COOB$, B is for example hydrogen, the radical $—CH_2—CH(OH)—CH_2Y$, alkyl, a group $—(CH_2—CH_2—O)_x—(CH_2—CH[CH_3]—O)_y—R_3$ or a cation, p and q are each independently of the other from 0 to 2, x and y are independently of the other from 0 to 250, subject to the proviso that the sum $(x+y) \geqq 1$, and $R_3$ is independently defined in the same way as $R_1$, with the proviso that at least one of the substituents B present in the molecule is a radical $—CH_2—CH(OH)—CH_2Y$, and Y is as defined above.

When $R_1$ or any other substituent is halogen, it is for example bromine, fluorine or in particular chlorine.

When $R_1$ or any other substituent is alkyl, it is for example $C_1$–$C_4$alkyl. Examples are n-propyl, isopropyl, n-butyl, isobutyl, sec-butyl, tert-butyl and, preferably, methyl or ethyl.

p is preferably 0 or 1.

q is preferably 0.

$R_3$ is preferably hydrogen or alkyl.

A cation B can be for example an alkali metal or alkaline earth metal cation, e.g. $Na^+$, $K^+$ or $Li^+$, or a quaternary inorganic or organic ammonium cation, e.g. $NH_4^+$ or $NR_4^+$, where R is alkyl which may be substituted, for example by hydroxyl.

B is preferably hydrogen, the radical $—CH_2—CH(OH)—CH_2Cl$, methyl, ethyl, a group $—(CH_2—CH_2—O)_x—(CH_2—CH[CH_3]—O)_y—R_3$, where $R_3$ is hydrogen, methyl or ethyl, or a cation. B is particularly preferably hydrogen, a cation or in particular the radical $—CH_2—CH(OH)—CH_2Cl$.

Preferred carboxylic acid derivatives (Ia) for use according to the invention are $\alpha,\beta$-ethylenically unsaturated compounds of the formula (1) where q is 0, $R_1$ and $R_2$ are independently of each other hydrogen, hydroxyl, chlorine, methyl, ethyl, —COOB or $—CH_2—COOB$, B is hydrogen, a cation or the radical $—CH_2—CH(OH)—CH_2Cl$, and $R_3$ is independently defined in the same way as $R_1$, with the proviso that at least one of the substituents B present in the molecule is a radical $—CH_2—CH(OH)—CH_2Y$.

Examples of suitable carboxylic acid derivatives R* under (Ia) are the radicals of (meth)acrylic acid, maleic acid, fumaric acid, itaconic acid, mesaconic acid, citraconic acid, vinylacetic acid, vinylpropionic acid, crotonic acid, aconitic acid, allylacetic acid, vinyloxyacetic acid, allyloxyacetic acid, $\alpha,\beta$-dimethyl(meth)acrylic acid, methylenemalonic acid, 2-hydroxy(meth)acrylic acid, 2-halo(meth)acrylic acid, $\alpha$-carboxyethyl acrylate, acrylamidoglycolic acid, $\beta$-carboxyethyl acrylate, allyloxy-3-hydroxybutanoic acid, allyloxymalonic acid, allylsuccinic acid and allylmalonic acid, in which further carboxyl groups present in the molecule may be esterified with a compound of the above-indicated formula (II). An ethylenically unsaturated carboxylic acid radical R* is particularly preferably a radical of acrylic acid, methacrylic acid, maleic acid or fumaric acid, in which a second carboxyl group present in the molecule may be esterified with a compound of the above-indicated formula (II).

When R is a radical R*—C(O)—O— and R* is the radical of a homo- or copolymer as per (Ib), R* is for example the radical of a homo- or copolymer composed of one or more of the aforementioned $\alpha,\beta$-unsaturated carboxylic acid derivatives with or without one or more copolymerisable monoethylenically unsaturated monomers and partially or completely esterified with a compound of the above-indicated formula (II).

Suitable copolymerisable monoethylenically unsaturated monomers are for example esters, amides or nitriles of unsaturated carboxylic acids, e.g. methyl acrylate, ethyl acrylate, methyl methacrylate, ethyl methacrylate, hydroxyethyl (meth)acrylate, hydroxypropyl (meth)acrylates, hydroxybutyl (meth)acrylates, dimethylaminoethyl (meth)acrylate, diethylaminoethyl (meth-)acrylate, acrylamide, methacrylamide, N-alkyl(meth)acrylamides, acrylonitrile or methacrylonitrile. Suitable comonomers include sulfo- or phosphono-containing monomers, e.g. (meth)allylsulfonic acid, vinylsulfonic acid, 3-allyloxy-2-hydroxypropanesulfonic acid, styrenesulfonic acid, acrylamidomethanesulfonic acid, 3-sulfopropyl(meth)acrylates, 3-sulfopropyl itaconates, 2-acrylamido-2-methylpropanesulfonic acid, vinyl phosphonate, allyl phosphonate and acrylamidomethylpropanephosphonic acid. It is also possible to use N-vinylpyrrolidone, N-vinyl-caprolactam, N-vinylformamide, N-vinyl-N-methylformamide, N-vinylacetamide, N-vinyl-N-methylacetamide, N-vinylimidazole, N-vinylmethylimidazole, N-vinyl-2-methylimidazole, N-vinylimidazoline, methyl vinyl ketone, vinyl acetate, vinyl propionate, vinyl butyrate, styrene, olefins having for example 2 to 10 carbon atoms such as ethylene, propylene, isobutylene, hexene, diisobutene and vinyl alkyl ether such as methyl vinyl ether, ethyl vinyl ether, dimethoxyethylene, n-butyl vinyl ether, isobutyl vinyl ether, hexyl vinyl ether or octyl vinyl ether, and mixtures thereof.

The parent homo- and copolymers of R* preferably have a molecular weight of 100 to 1,000,000, particularly preferably of 500 to 50,000, and very particularly preferably of 500 to 5000.

The homo- or copolymers (Ib) for use according to the invention are for example polymers containing structural elements of the formula

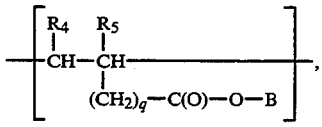

(2)

where B and q are each independently as defined above and $R_4$ and $R_5$ are each independently of the other defined in the same way as $R_1$, with or without structural elements of the formula $$\dagger A \dagger, \quad (3)$$

where A is the radical of one of the aforementioned copolymerisable monoethylenically unsaturated monomers.

In this context, B is subject to the aforementioned definitions and preferences, $R_4$ and $R_5$are independently subject to the definitions and preferences given above for $R_1$, and q is preferably 0.

Preference is given to homo- and copolymers of mono-, di- or tricarboxylic acid derivatives with or without one or more comonomers, in which 5–100%, preferably 10–85%, particularly preferably 10–40%, of the carboxyl groups are present in the form of the 2-hydroxy-3-chloropropyl ester and the remaining carboxyl groups are present in the form of a $C_1$–$C_4$alkyl ester or preferably in the form of the free acid or a salt thereof. Particular preference is given to homo- or copolymers based on acrylic acid or maleic acid.

When R is a radical of the formula R*—C(O)—O— and R* is the radical of a modified sugar derivative as per (Ic), R* is for example the radical of a carboxyl-containing mono-, di-, tri-, oligo- or polysaccharide. Examples of such saccharides are carboxymethylcellulose, carboxymethyl starch, oxidised sugar derivatives, reaction products of a carbohydric material with an $\alpha,\beta$-unsaturated dicarboxylic acid as described for example in DE-A 2,439,155, or alkyl monoglucoside or alkyl polyglucoside ether carboxylates as described for example in EP-A 0 457 155; the saccharities mentioned are each partially or completely esterified with a compound of the above-indicated formula (II).

When R is a radical R*—C(O)—O— and R* is the radical of a saturated carboxylic acid as per (Id), the underlying carboxylic acid has for example a molecular weight of 46 to 50,000, preferably 60 to 5000.

Examples of saturated carboxylic acids from which the radical R* may be derived are saturated $C_1$–$C_2$-0mono- or -dicarboxylic acids such as acetic acid, propionic acid or succinic acid, isoserinediacetic acid, nitrilotriacetic acid, ethylenediaminetriacetic acid, diethylenetriaminepentaacetic acid, hydroxyethylenediaminotriacetic acid, hydrocarboxylic acids, e.g. malic acid, citric acid, hydroxycitric acid, lactic acid, tartronic acid, tartaric acid, amino acid derivatives, e.g. aspartic acid, $\beta$-alanine, glutamic acid, polyaspartic acid, hydroxyiminodisuccinic acid or derivatives thereof as described for example in U.S. Pat. No. 4,983,315, oligo- or polyglycerol ether carboxylates as described for example in DE-A 4 014 202, or glycerol derivates as described for example in U.S. Pat. No. 4,639,325.

A saturated carboxylic acid radical R* is preferably the radical of a $C_2$–$C_{10}$mono- or -dicarboxylic acid, $C_2$–$C_{10}$hydroxycarboxylic acid or hydroxyiminodisuccinic acid or particularly preferably the radical of a saturated $C_2$–$C_4$mono- or -dicarboxylic acid or $C_3$–$C_6$-hydroxycarboxylic acid.

The diols of the formula $$HO\ CH_2—CH(OH)—CH_2Y,$$

the ethylenically unsaturated mono-, di- or tricarboxylic acid derivatives of (Ia) and the polymers of (Ib) are known for example from DE-A-2,424,892 or can be obtained by methods known per se.

The polymers of (Ib) can be obtained for example in a conventional manner by (co)polymerising the corresponding monomers which conform for example to the above-indicated formula (1). If desired, the monomers of the formula (1) are copolymerised with further monomers, for example those from which the radical A is derived.

The polymers of (Ib) can be obtained with advantage by reacting a homo- or copolymer containing for example structural elements of the formula

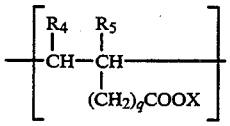

(2a)

with or without structural elements of the formula $$\dagger A \dagger, \quad (3)$$

where $R_4$, $R_5$, A and q are each as defined as preferred above and X is hydrogen or a cation, with an epihalohydrin, preferably epibromohydrin or in particular epichlorohydrin, in the presence of a catalyst. The catalyst used is a tertiary amine, quaternary ammonium salt or, preferably, a metal salt such as NaCl, KCl or LiCl. The reaction is carried out for example in an aqueous medium or in a medium composed of water and an organic solvent, and the temperatures used are for example 50°-100° C., preferably 70°-90° C. The reaction is preferably carried out using a (co)polymer of one or more of the aforementioned ethylenically unsaturated mono-, di- or tricarboxylic acids with or without one or more comonomers without free acid function, and this (co)polymer is preferably reacted with an epihalohydrin; the use of an excess of epihalohydrin is preferred, but by varying the molar quantities it is possible to control the degree of esterification. The resulting dihalopropanol and 3-halo-1,2-dihydroxypropane can be separated off in a conventional manner, for example by azeotropic distillation; however, it is preferable for the mixture of polymer (Ib) and diol of the formula (I) where R is hydroxyl, that is obtained after the dihalopropanol has been removed by distillation and after appropriate working up and/or formulation to be used directly as a wool preservative.

The modified sugar derivatives of (Ic) can be obtained analogously to the polymers of (Ib) by reacting the known carboxyl-containing modified sugar derivatives with an epihalohydrin.

The carboxylic acid derivatives of (Id) can be obtained analogously to the compounds of (Ia).

The wool preservatives used according to the invention may contain one or more of the compounds of the formula (1). Preferred embodiments of the present invention concern (aI) the use of a wool preservative comprising the diol of the formula $HO—CH_2—CH(OH)—CH_2Cl$ as the sole active ingredient;

(aII) the use of a wool preservative comprising one or more compounds of the above-indicated formula (1) where B is the radical $—CH_2—CH(OH)—CH_2Cl$ as the active component;

(aIII) the use of a wool preservative comprising a homo- or copolymer composed of structural elements of the above-indicated formula (2) with or without structural elements of the formula (3) and in which 5-100%, preferably 10-85% and particularly preferably 10-40%, of the carboxyl groups are present in the form of the 2-hydroxy-3-chloropropyl ester and the remaining carboxyl groups are present in the form of a $C_1$-$C_4$alkyl ester or in the form of the free acid or one of its salts, as the active ingredient;

(aIV) the use of a wool preservative comprising a mixture of the diol of the formula $HO—CH_2—CH(OH)—CH_2Cl$ and a homo- or copolymer containing structural elements of the formula (2) where B is the radical $—CH_2—CH(OH)—CH_2Cl$;

(aV) the use of a wool preservative comprising a mixture of the diol of the formula $HO—CH_2—CH(OH)—CH_2Cl$ and a compound of the above-indicated formula (I) where Y is chlorine, R is a radical R*—C(O)—O— and R* is the radical of a saturated $C_2$-$C_4$-mono- or -dicarboxylic acid.

A further preferred embodiment of the present invention concerns the use of a wool preservative comprising a diol of the formula $$HO—CH_2—CH(OH)—CH_2Y \quad (II),$$

where Y is as defined above and is in particular chlorine, and further compounds free of a radical of the formula $—O—CH_2—CH(OH)—CH_2—Y$. Examples of compounds without $—O—CH_2—CH(OH)—CH_2—Y$ are (a) ethylenically unsaturated mono-, di- or tricarboxylic acid derivatives, (b) homo- or copolymers of ethylenically unsaturated mono-, di- or tricarboxylic acid derivatives with or without one or more comonomers, (c) carboxyl-containing modified sugar derivatives, (d) saturated mono-, di-, tri-, tetra- or pentacarboxylic acid derivatives, or (e) salts of mineral acids.

Suitable ethylenically unsaturated carboxylic acid derivatives (a) conform for example to the above-indicated formula (1), where B is hydrogen, alkyl, a group $—(CH_2—CH_2—O)_x—(CH_2—CH[CH_3]—O)_y—R_3$ or a cation and $R_1$, $R_2$, $R_3$, p, q, x and y are each as defined above.

Examples of preferred carboxylic acid derivatives (a) are itaconic acid, mesaconic acid, citraconic acid, vinylacetic acid, vinylpropionic acid, crotonic acid, aconitic acid, allylacetic acid, vinyloxyacetic acid, allyloxyacetic acid, α,β-dimethyl(meth)acrylic acid, methylenemalonic acid, 2-hydroxy(meth)acrylic acid, 2-halo(meth)acrylic acid, α-carboxyethyl acrylate, acrylamidoglycolic acid, β-carboxyethyl acrylate, allyloxy-3-hydroxybutanoic acid, allyloxymalonic acid, allylsuccinic acid, allylmalonic acid or in particular acrylic acid or methacrylic acid, maleic acid or fumaric acid.

Examples of suitable homo- or copolymers (b) are homo- or copolymers composed of one or more of the abovementioned α,β-unsaturated carboxylic acid derivatives with or without one or more of the aforementioned copolymerisable monoethylenically unsaturated monomers. Preference is here given to homo- or copolymers based on (meth)acrylic acid or maleic acid having a molecular weight of for example 500 to 5,000.

Examples of modified sugar derivatives (c) are carboxymethylcellulose, carboxymethyl starch, oxidised sugar derivatives, reaction products of a carbohydrate material, an α,β-unsaturated dicarboxylic acid and an alkaline earth metal hydroxide as described for example in DE-A-2,439,155 or alkyl monoglucoside or alkyl polyglucoside ether carboxylates, as described for example in EP-A-0 457 155.

Examples of suitable saturated carboxylic acid derivatives (d) are saturated $C_1$-$C_{20}$mono- or -dicarboxylic acids such as acetic acid, propionic acid or succinic acid, isoserinediacetic acid, nitrilotriacetic acid, ethylenediaminetriacetic acid, diethylenetriaminepentaacetic acid, hydroxyethylenediaminotriacetic acid, hydrocarboxylic acids, e.g. malic acid, citric acid, hydroxycitric acid, lactic acid, tartronic acid, tartaric acid, amino acid derivatives, e.g. aspartic acid, β-alanine, glutamic acid, polyaspartic acid, hydroxyiminodisuccinic acid or derivatives thereof as described for example in U.S. Pat. No. 4,983,315, oligo- or polyglycerol ether carboxylates as described for example in DE-A 4 014 202, or glycerol derivates as described for example in U.S. Pat. No. 4,639,325, or salts thereof.

The preferred saturated carboxylic acid derivatives (d) are saturated $C_2$-$C_{10}$mono- or -dicarboxylic acids, $C_2$-$C_{10}$hydroxycarboxylic acids or hydroxyiminodisuccinic acid, and their alkaline earth metal, alkali metal or ammonium salts and in particular a $C_2$–$C_4$mono- or -dicarboxylic acid or a $C_3$–$C_6$hydroxycarboxylic acid. Examples of particularly preferred carboxylic acid derivatives (d) are malic acid, citric acid, lactic acid, tartaric acid, acetic acid, propionic acid and succinic acid.

Examples of suitable salts of mineral acids (e) are alkaline earth metal, alkali metal or ammonium salts of mineral acids such as hydrochloric acid, sulfuric acid, nitric acid or phosphoric acid. Preference is given to using alkali metal salts of hydrochloric acid, sulfuric acid or phosphoric acid, e.g. sodium, potassium or lithium chloride, sulfate or phosphate.

Particularly preferred embodiments of the present invention concern (bI) the use of a wool preservative comprising the diol of the formula $$HO—CH_2—CH(OH)—CH_2Cl$$

and a $C_2$–$C_{10}$hydroxycarboxylic acid;

(bII) the use of a wool preservative comprising the diol of the formula $$HO—CH_2—CH(OH)—CH_2Cl$$

and a saturated $C_2$–$C_{10}$mono- or -dicarboxylic acid;

(bIII) the use of a wool preservative comprising the diol of the formula $$HO—CH_2—CH(OH)—CH_2Cl$$

and acrylic acid, methacrylic acid, maleic acid or fumaric acid;

(bIV) the use of a wool preservative comprising the diol of the formula $$HO—CH_2—CH(OH)—CH_2Cl$$

and a homo- or copolymer containing structural elements of the above-indicated formula (2) where B is hydrogen or a cation;

(bV) the use of a wool preservative comprising the diol of the formula $$HO—CH_2—CH(OH)—CH_2Cl$$

and a homo- or copolymer based on (meth)acrylic acid or maleic acid and having a molecular weight of 500 to 5,000;

(bVI) the use of a wool preservative comprising the diol of the formula $$HO—CH_2—CH(OH)—CH_2Cl$$

and an alkaline earth metal, alkali metal or ammonium salt of hydrochloric acid, sulfuric acid or phosphoric acid.

When the wool preservative used is a mixture of a diol of the formula (II) and further compounds, for example a mixture as per (aIV), (aV) or (bI)–(bVI), the components are advantageously used in a weight ratio of diol:other compounds of from 5:95 to 80:20, preferably from 5:95 to 50:50, particularly preferably from 5:95 to 30:70, very particularly preferably from 10:90 to 30:70.

Preferably the wool preservative used is an aqueous solution containing $\leqq 10\%$ by weight, in particular 5–10% by weight, of a diol of the formula (II) with or without 30 to 50% by weight, each percentage being based on the total formulation, of a further compound, for example as per (aIV), (aV) or (bI)–(bVI).

The general procedure is to dye the fibrous material made of or containing wool in the presence of, for example, 0.5 to 10% by weight, preferably 1 to 6% by weight, on weight of fibre, of one or more compounds of the formula (I) according to the invention.

A preferred embodiment of the present invention concerns a method for dyeing fibrous materials made of or containing wool with anionic dyes, which comprises dyeing these materials in the presence of 0.5 to 10% by weight, on weight of fibre, of a wool preservative comprising the diol of the formula $$HO—CH_2CH(OH)—CH_2Cl$$

A further preferred embodiment of the present invention concerns a method for dyeing fibrous materials made of or containing wool with anionic dyes, which comprises dyeing these materials in the presence of 0.5 to 10% by weight, on weight of fibre, of a wool preservative comprising the diol of the formula $$HO—CH_2CH(OH)—CH_2Cl$$

and a homo- or copolymer containing structural elements of the above-indicated formula (2) where B is hydrogen or a cation and $R_4$ and $R_5$ are each independently of the other hydrogen, hydroxyl, cyano, halogen or $C_1$–$C_4$alkyl, and q is 0, in a weight ratio of diol:polymer of from 5:95 to 30:70, preferably from 10:90 to 30:70.

A particularly preferred embodiment of the present invention concerns a method for dyeing fibrous materials made of or containing wool with anionic dyes, which comprises dyeing these materials in the presence of 0.5 to 10% by weight, on weight of fibre, of a wool preservative comprising the diol of the formula $$HO—CH_2CH(OH)—CH_2Cl$$

and a homo- or copolymer containing structural elements of the above-indicated formula (2) where B is a radical $—CH_2—CH(OH)—CH_2Cl$, $R_4$ and $R_5$ are each independently of the other hydrogen, hydroxyl, cyano, halogen, $C_1$–$C_4$alkyl or $—C(O)O—CH_2—CH(OH)—CH_2Cl$, and q is 0, in a weight ratio of diol:polymer of from 5:95 to 30:70, preferably from 10:90 to 30:70.

A very particularly preferred embodiment of the present invention concerns a method for dyeing fibrous materials made of or containing wool with anionic dyes, which comprises dyeing these materials in the presence of 0.5 to 10% by weight, on weight of fibre, of a wool preservative comprising the diol of the formula $$HO—CH_2CH(OH)—CH_2Cl$$

and a $C_2$–$C_{10}$hydroxycarboxylic acid, a saturated $C_2$–$C_{10}$mono- or dicarboxylic acid or an alkaline earth metal, alkali metal or ammonium salt of hydrochloric acid, sulfuric acid or phosphoric acid in a weight ratio of diol:hydroxycarboxylic acid, carboxylic acid or mineral salt of 5:95 to 30:70, preferably from 10:90 to 30:70.

The fibrous material in question can be wool alone or a blend off for example, wool/nylon or wool/polyester. Mixtures of wool and nylon are preferably dyed with anionic dyes and mixtures of wool and polyester fibres are preferably dyed with disperse and anionic dyes.

Suitable anionic dyes and disperse dyes are known to the person skilled in the art.

The fibrous material can be present in various stages of processing, for example in the form of yarn, staple, slubbing, knitted material, bonded fibre web material or preferably woven fabric.

The blends are preferably blends of wool and polyester which in general comprise 20 to 50 parts by weight of wool to 80–50 parts by weight of polyester. The fibre blends preferred for the method of the invention contain 45 parts of wool to 55 parts of polyester.

The liquor ratio of the method according to the invention can be varied within wide limits; it can be for example from 1:1 to 100:1, preferably from 10:1 to 50:1.

As well as the dye, water and the wool assistant, the dyebath may contain further, customary additaments. Examples are mineral acids, organic acids and/or salts thereof which serve to set the pH of the dyebath, also electrolytes, levelling, wetting and antifoaming agents and also, in the event of a wool/polyester blend being dyed, carriers and/or dispersants.

The dyebath has a pH of for example 4 to 6.5, preferably from 5.2 to 5.8. The method of the invention is in general carried out at a temperature of, for example, 60° to 130° C.

When the material to be dyed is wool alone, the dyeing is advantageously carded out by the exhaust method, for example at a temperature within the range from 60° to 160° C., preferably 95° to 98° C. The dyeing time can vary as a function of the requirements, but is preferably 60–120 minutes.

Polyester/wool blends are advantageously dyed in a single bath from an aqueous liquor by the exhaust method. Preference is given to dyeing by the high temperature process in closed, pressure-resistant machines at temperatures above 100° C., advantageously between 110° and 125° C., preferably at 118°–120° C., under atmospheric or superatmospheric pressure.

The fibre blends can also be dyed by the usual carder method at temperatures below 106° C., for example within the temperature range from 75° to 98° C., in the presence of one or more carriers.

Polyester/wool blends can be dyed by first treating them with the wool preservative with or without the carrier and then dyeing. It is also possible to treat the material simultaneously with the wool preservative, the dyes and any assistants. It is preferable to introduce the blend material into a liquor which contains the wool preservative with or without further, customary assistants and is at a temperature of 40°–50° C., and the material is treated at that temperature for 5 to 15 minutes. Then the temperature is raised to about 60°–70° C., the dye is added, the liquor is slowly raised to the dyeing temperature and then dyeing is carried out at that temperature for about 20 to 60, preferably 30 to 45, minutes. At the end the liquor is cooled back down to about 60° C. and the dyed material is worked up in a conventional manner.

The process of the invention makes it possible to dye wool or in particular wool/polyester blends at a high temperature without damaging the wool content in any way, i.e. while preserving important, fibre-technological properties of the wool, such as tensile strength, burst resistance and elongation at break. It is also to be noted that the polyester content of blend fabrics is free of any yellowing.

The examples which follow illustrate the invention. Parts and percentages are by weight.

Preparation of Homo- and Copolymers

EXAMPLE 1

A sulfonation flask is charged with 87.5 pans of hydrolysed polymaleic anhydride (0.5 COOH equivalents, molecular weight 500–2,000, e.g. Belclene® 200), 80 parts of water and 3 parts of NaCl. After 31 parts of epichlorohydrin have been added, the reaction mixture is heated to 80°–85° C. for about 1 hour, cooled down to room temperature and neutralised with sodium hydroxide solution (pH about 6.8). Excess epichlorohydrin and dichloropropanol formed in the course of the reaction are then distilled off azeotropically. After adjustment to a solids concentration of 50%, the product is a mixture of 35% of polymer, 15% of 3-chloro-1,2-propanediol and 50% of water.

EXAMPLE 2

A suitable reaction vessel is charged with 107 parts of a terpolymer of acrylic ester, vinyl acetate and maleic anhydride (0.6 COOH equivalents, e.g. Belclene® 283), 90 parts of water and 4 parts of NaCl. After 90 pans of epichlorohydrin have been added, the reaction mixture is heated to 80°–85° C. for about 1 hour, cooled down to room temperature and neutralised with sodium hydroxide solution (pH about 6.8). Excess epichlorohydrin and dichloropropanol formed in the course of the reaction are then distilled off azeotropically. The product is adjusted to contain 25% of polymer, 25% of 3-chloro-1,2-propanediol and 50% of water.

EXAMPLE 3

A suitable reaction vessel is charged with 41.6 parts of a copolymer of acrylic acid and maleic acid (0.3 acid equivalents, e.g. Sokalan® 12S), 10 parts of water and 1.8 parts of NaCl. After 39.3 parts of epichlorohydrin have been added, the reaction mixture is heated to 80°–85° C. for about 90 minutes, cooled down to room temperature and neutralised with sodium hydroxide solution (pH about 6.8). Excess epichlorohydrin and dichloropropanol foraged in the course of the reaction are then distilled off azeotropically. The product is adjusted to contain 35% of polymer, 15% of 3-chloro-1,2-propanediol and 50% of water.

EXAMPLE 4

Example 1 is repeated using a polymer that is a copolymer of acrylic acid and maleic acid (molecular weight about 50,000, e.g. Sokalan® CP 7) and, after the reaction with epichlorohydrin, precipitating the polymeric product obtained in ethanol and isolating it. It is a polycarboxylic acid derivative in which 30% of the carboxyl groups are present in the form of the 2-hydroxy-3-chloropropyl ester and the remaining 70% in the form of the free acid or its sodium salt.

EXAMPLE 5

A 40% solution of a terpolymer of acrylic ester, vinyl acetate and maleic anhydride (0.6 COOH equivalents, e.g. Belclene® 283) is prepared and substantially neutralised with sodium hydroxide solution (pH about 6.8). 85 parts of this polymer solution are mixed with 15 parts of an aqueous solution containing 40% by weight of 3-chloro-1,2-propanediol and stirred until homogeneous.

EXAMPLE 6

In a sulfonation flask, 890.4 g of an oxidised oligosaccharide (0.8 COOH equivalents, molecular weight 500–3,000) are adjusted to pH 1.1 with 800 ml of 1N hydrochloric acid. After 162.8 g of epichlorohydrin have been added, the reaction mixture is heated at 80°–85° C. until about 90% of the carboxyl groups have reacted (about 2 hours), cooled down to room temperature and neutralised. Then excess epichlorohydrin and dichloropropanol formed in the course of the reaction are distilled off azeotropically, and the remaining solution is adjusted to contain 34% by weight of sugar derivative, 16 % by weight of 3-chloro-1,2-propanediol and 50% by weight of water.

EXAMPLE 7

80 parts of a 15% aqueous carboxymethyl starch solution (Brookfield viscosity of a 10% solution at 85° C. about 60 Cps with spindle 1, e.g. Erasize® 60 from Emsland-Stärke) are mixed with 20 parts of a 15% aqueous 3-chloro-1,2-propanediol solution.

EXAMPLE 8

80 parts of a 50% aqueous solution of the compound of the formula $CH_2(COOH)—CH(COOH)—O—CH_2—CH[O—CH(COOH)—CH_2—COOH]—CH_2—O—CH(COOH)—CH_2—COOH$ at pH 8 (prepared as described in U.S. Pat. No. 4,639,325) are mixed with 20 parts of a 50% aqueous 3-chloro-1,2-propanediol solution until homogeneous.

EXAMPLE 9

85 parts of a 50% aqueous solution of the compound of the formula $CH_2(COOH)—CH(COOH)—NH—CO—CH_2—NH—CH(COOH)—CH_2(COOH)$ at pH 7 (prepared as described in U.S. Pat. No. 4,983,315) are mixed with 15 parts of an aqueous 50% 3-chloro-1,2-propanediol solution until homogeneous.

EXAMPLE 10

85 parts of a 50% acetic acid solution at pH 3 are mixed with 15 parts of a 50% aqueous 3-chloro-1,2-propanediol solution until homogeneous.

EXAMPLE 11

75 parts of a 30% succinic acid solution at pH 5.5 are mixed with 25 parts of a 30% aqueous 3-chloro-1,2-propanediol solution until homogeneous.

EXAMPLE 12

85 parts of a 50% malic acid solution at pH 6 are mixed with 15 parts of a 50% aqueous 3-chloro-1,2-propanediol solution until homogeneous.

EXAMPLE 13

82 parts of a 50% lactic acid solution at pH 4 are mixed with 18 parts of a 50% aqueous 3-chloro-1,2-propanediol solution until homogeneous.

EXAMPLE 14

85 parts of a 50% N-(1,2-dicarboxy-2-hydroxyethyl-)aspartic acid solution at pH 6.5 are mixed with 15 parts of a 50% aqueous 3-chloro-1,2-propanediol solution until homogeneous.

EXAMPLE 15

80 parts of a 50% polyaspanic acid solution (molecular weight about 3,000) at pH 6.5 are mixed with 20 parts of a 50% aqueous 3-chloro-1,2-propanediol solution until homogeneous.

EXAMPLE 16

57.6 g of citric acid, 55.5 g of epichlorohydrin and 0.5 g of benzyltributylammonium bromide are introduced into a sulfonation flask, heated at 80° C. for about 4.5 hours and then dried under reduced pressure. The solution is then adjusted to a solids content of 50%.

EXAMPLE 17

69.7 g of maleic acid, 2.6 g of iron(III) chloride and 100 ml of chloroform are introduced into a sulfonation flask. While stirring, the suspension is heated to 60° C. and then admixed with 111 g of epichlorohydrin at 60° to 70° C., added dropwise over about 2 hours. The reaction solution is further stirred at 60° to 65° C. for about 20 hours, then diluted with water and adjusted to about pH 6. The product is extracted with chloroform and then dried under reduced pressure.

EXAMPLE 18

75 parts of a 35% sulfuric acid solution previously adjusted to pH 3.3 with sodium hydroxide solution are mixed with 25 parts of a 35% aqueous 3-chloro-1,2-propanediol solution until homogeneous.

Dyeing Examples

EXAMPLE 19

100 parts of a blend fabric, 55% of polyester and 45% of wool, are pretreated for 5 min at 40° C. in a circulation machine with a liquor containing 2.0 parts of an aqueous preparation as prepared in Example 1, 0.5 pan of a sulfated fatty amine polyglycol ether, 1.0 part of a commercial assistant mixture (based on carboxyl- and phosphoryl-aromatic compounds) and 2.0 parts of sodium acetate in 1,200 parts of water and which has been adjusted to pH 5.5 with acetic acid. The liquor is then heated over 30 minutes to 120° C. with the addition at 70° C. of 2.0 parts of a dye mixture consisting of 1.6 parts by weight of the dye of the formula

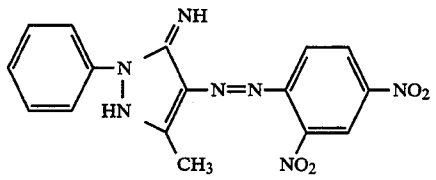

60% by weight of the dye of the formula

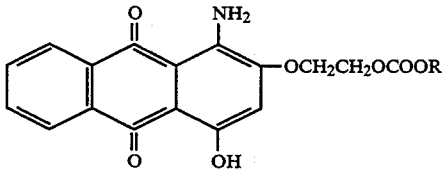

(R = 50% $—CH_2—CH_3$ + 50% $—C_6H_5$)

5.0% by weight of the dye of the formula

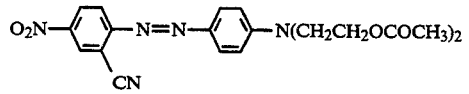

4.0 parts of the dye of the formula

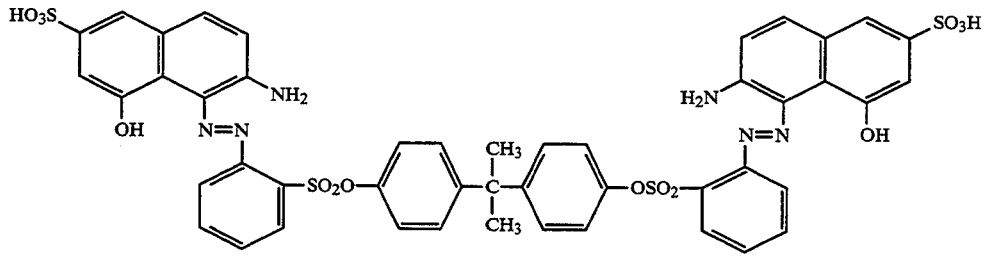

3.3 parts of the dye of the formula

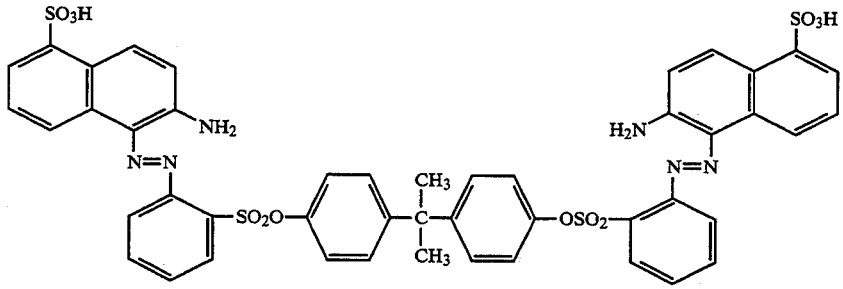

15.0 parts of the dye of the formula

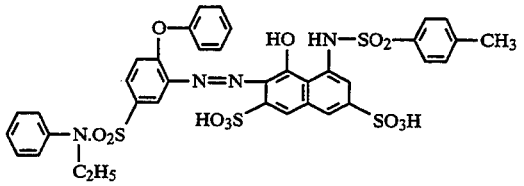

and 10 parts of sodium sulfate. This is followed by dyeing at 120° C. for 40 min, after which the liquor is cooled down to 60° C. Then the usual afterwash is carried out. The result is a rub-fast level, red solid dyeing which is free of any deterioration in the quality of the wool.

Using instead of the aqueous preparation of Example 1, (a) 2 parts of the preparation of Example 2,
(b) 2 parts of the preparation of Example 3,
(c) 1.5 parts of the preparation of Example 4,
(d) 2.5 parts of the preparation of Example 5,
(e) 0.4 part of 2-hydroxy-3-chloro-propyl acrylate,
(f) 1 part of 3-chloro-1,2-propanediol,
(g) 3.3 parts of the preparation of Example 6,
(h) 9 parts of the preparation of Example 7,
(i) 3 parts of the preparation of Example 9,
(j) 3.6 parts of the preparation of Example 8,
(k) 2.4 parts of the preparation of Example 10,
(l) 4.7 parts of the preparation of Example 11
(m) 2.4 parts of the preparation of Example 12,
(n) 3 parts of the preparation of Example 13,
(o) 2.6 parts of the preparation of Example 14,
(p) 3.5 parts of the preparation of Example 15,
(q) 2 parts of the preparation of Example 16,
(r) 1.5 parts of the preparation of Example 17 or
(s) 3.9 parts of the preparation of Example 18, likewise gives dyeings which have good properties and are free of any adverse effect on the quality of the wool.

EXAMPLE 20

100 parts of a wool fabric weighing 180 g/m$^2$ are treated in 1,000 parts of aqueous liquor containing 4 parts of ammonium sulfate, 2 parts of an aqueous preparation as obtained in Example 1 and 0.5 part of a naphthalenesulfonic acid condensation product at 50° C. for 10 min; the pH of the liquor is first adjusted to about 6 with acetic acid. Then 3 parts of the dye of the formula

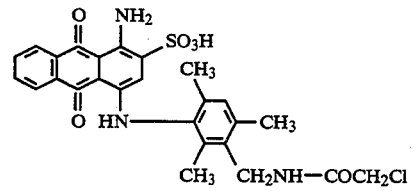

are added and the treatment is continued for a further 5 min. The dyeing liquor is then heated over about 45 min to about 98° C. and the fabric is dyed at that temperature for 60 min. This is followed by cooling down to about 60° C., a customary rinse and drying of the dyed fabric. The result is a rub-fast, level blue dyeing free of any adverse effect on the quality of the wool.

Using instead of the aqueous preparation of Example 1

(a) 2 parts of the preparation of Example 2,
(b) 2 parts of the preparation of Example 3,
(c) 1.5 parts of the preparation of Example 4,
(d) 2.5 parts of the preparation of Example 5,
(e) 0.4 part of 2-hydroxy-3-chloro-propyl acrylate,
(f) 1 part of 3-chloro-1,2-propanediol,
(g) 3.3 parts of the preparation of Example 6,
(h) 9 parts of the preparation of Example 7,
(i) 3 parts of the preparation of Example 9, (j) 3.6 parts of the preparation of Example 8,
(k) 2.4 parts of the preparation of Example 10,
(l) 4.7 parts of the preparation of Example 11
(m) 2.4 parts of the preparation of Example 12,
(n) 3 parts of the preparation of Example 13,
(o) 2.6 parts of the preparation of Example 14,
(p) 3.5 parts of the preparation of Example 15,
(q) 2 parts of the preparation of Example 16,
(r) 1.5 parts of the preparation of Example 17 or
(s) 3.9 parts of the preparation of Example 18, likewise gives dyeings which have good properties and are free of any adverse effect on the quality of the wool.

EXAMPLE 21

10 parts each of a wool fabric and of a bleached polyester fabric are pretreated together for 5 min at 40° C. in 200 parts of a liquor, adjusted with acetic acid to pH 5.5, containing 0.8 part of the aqueous preparation of Example 1 and 0.4 part of sodium acetate. The liquor is then heated over 30 min to 120° C., the fabric is treated at that temperature for 40 min, and the liquor is then cooled down to 60° C. After this blank treatment (without dye) the wool fabric shows now sign of loss of quality, for example in respect of the burst resistance; nor does the adjacent polyester fabric show any sign of yellowing due to hydrolytic degradation of wool.

Similar effects concerning the burst resistance of wool and the non-yellowing of the polyester fabric are obtained on using instead of the aqueous preparation of Example 1

(a) 0.8 part of the preparation of Example 2,
(b) 0.8 part of the preparation of Example 3,
(c) 0.6 part of the preparation of Example 4,
(d) 1 part of the preparation of Example 5,
(e) 0.2 part of 2-hydroxy-3-chloro-propyl acrylate,
(f) 0.4 part of 3-chloro-1,2-propanediol,
(g) 1.3 parts of the preparation of Example 6,
(h) 3.6 parts of the preparation of Example 7,
(i) 1.2 parts of the preparation of Example 9,
(j) 1.5 parts of the preparation of Example 8,
(k) 1 part of the preparation of Example 10,
(l) 1.9 parts of the preparation of Example 11
(m) 1 part of the preparation of Example 12,
(n) 1.1 parts of the preparation of Example 13,
(o) 1.1 parts of the preparation of Example 14,
(p) 1.4 parts of the preparation of Example 15,
(q) 0.8 parts of the preparation of Example 16,
(r) 0.6 parts of the preparation of Example 17 or
(s) 1.6 parts of the preparation of Example 18.

What is claimed is:

1. A method for dyeing fibrous material made of or containing wool with an anionic dye, which comprises dyeing this material in the presence of a wool preservative comprising at least one compound of the formula $$R—CH_2—CH(OH)—CH_2—Y \quad (I),$$

where

Y is halogen, R is hydroxy or a radical R*—C(O)—O—, and

R* is (Ia) the radical of an ethylenically unsaturated mono-, di- or tricarboxylic acid, in which in the case of a di- or tricarboxylic acid the remaining carboxyl group or groups are or are not partly or wholly esterified with a compound of the formula $$HO—CH_2—CH(OH)—CH_2—Y \quad (II)$$

and Y is as defined above, (Ib) the radical of a homo- or copolymer of ethylenically unsaturated mono-, di- or tricarboxylic acid derivatives with or without one or more comonomers, in which the carboxyl groups are wholly or partly esterified with a compound of the above-indicated formula (II), (Ic) the radical of a carboxyl-containing modified sugar derivative, in which, if it has more than one carboxyl group, the remaining carboxyl group or groups are or are not esterified with a compound of the above-indicated formula (II), or (Id) the radical of a saturated mono-, di-, tri-, tetra- or pentacarboxylic acid, in which in the case of a di-, tri-, tetra- or pentacarboxylic acid the remaining carboxyl group or groups are or are not wholly or partly esterified with a compound of the above-indicated formula (II).

2. A method according to claim 1, wherein Y is chlorine.

3. A method according to claim 1, wherein the wool preservative used comprises a compound as per (Ia) of the formula

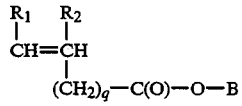

(1)

where $R_1$ and $R_2$ are independently of each other hydrogen, hydroxyl, halogen, alkyl or a group $—(CH_2)_p—COOB$, B is hydrogen, the radical $—CH_2—CH(OH)—CH_2Y$, alkyl, a group $—(CH_2—CH_2—O)_x—(CH_2—CH[CH_3]—O)_y—R_3$ or a cation, p and q are each independently of the other from 0 to 2, x and y are independently of the other from 0 to 250, subject to the proviso that the sum $(x+y) \geqq 1$, and $R_3$ is independently defined in the same way as $R_1$, with the proviso that at least one of the substituents B present in the molecule is a radical $—CH_2—CH(OH)—CH_2Y$, and Y is as defined in claim 1.

4. A method according to claim 1, wherein R* in the formula (I) is the radical of acrylic acid, methacrylic acid, maleic acid or fumaric acid, in which a second carboxyl group in the molecule may be esterified with a compound of the formula (II) indicated in claim 1.

5. A method according to claim 1, wherein R* is the radical of a homo- or copolymer as per (Ib) containing structural elements of the formula

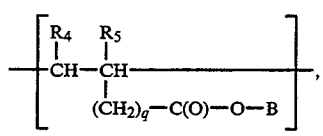

(2)

where $R_4$ and $R_5$, are each independently of the other hydrogen, hydroxyl, chlorine, methyl, ethyl or a group $—CH_2—COOB$, B is hydrogen, the radical $—CH_2—CH(OH)—CH_2Cl$ or a cation, and q is 0, with the proviso that at least one of the substituents B present in the molecule is a radical $—CH_2—CH(OH)—CH_2Y$ and Y is as defined in claim 1, with or without structural elements of the formula $$\text{+A+}, \quad (3)$$

where A is the radical of a copolymerisable monoethylenically unsaturated monomer.

6. A method according to claim 5, wherein the homo- or copolymer has a molecular weight of 500–50,000.

7. A method according to claim 5, wherein 5–100% of the carboxyl groups present in the homo- or copolymer are present therein in the form of the 2-hydroxy-3-chloropropyl ester and the remaining carboxyl groups are present in the form of a $C_1$–$C_4$alkyl ester or in the form of the free acid or one of its salts.

8. A method according to claim 1, wherein R* is the radical of a $C_2$–$C_{10}$mono- or -dicarboxylic acid or $C_2$–$C_{10}$hydroxycarboxylic acid or the radical of hydroxyiminodisuccinic acid.

9. A method according to claim 1, wherein the fibrous material made of or containing wool is dyed in the presence of a wool preservative comprising the diol of the formula $$HO—CH_2—CH(OH)—CH_2Cl$$

as the sole active ingredient.

10. A method according to claim 1, wherein the fibrous material made of or containing wool is dyed in the presence of a wool preservative comprising the diol of the formula $$HO—CH_2—CH(OH)—CH_2Cl$$

and a homo- or copolymer containing structural elements of the formula

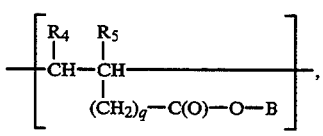

(2)

where $R_4$ and $R_5$, are each independently of the other hydrogen, hydroxyl, chlorine, methyl, ethyl or a group $—CH_2—COOB$, q is 0, and B is the radical $—CH_2—CH(OH)—CH_2Cl$.

11. A method according to claim 1, wherein the fibrous material made of or containing wool is dyed in the presence of a wool preservative comprising the diol of the formula $$HO—CH_2—CH(OH)—CH_2Cl$$

and a $C_2$–$C_{10}$hydroxycarboxylic acid.

12. A method according to claim 1, wherein the fibrous material made of or containing wool is dyed in the presence of a wool preservative comprising the diol of the formula $$HO—CH_2—CH(OH)—CH_2Cl$$

and a saturated $C_2$–$C_{10}$mono- or-dicarboxylic acid.

13. A method according to claim 1, wherein the fibrous material made of or containing wool is dyed in the presence of a wool preservative comprising the diol of the formula $$HO—CH_2—CH(OH)—CH_2Cl$$

and a homo- or copolymer containing structural elements of the formula

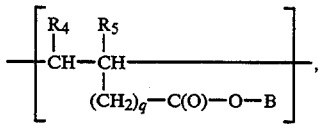

(2)

where $R_4$ and $R_5$, are each independently of the other hydrogen, hydroxyl, chlorine, methyl, ethyl or a group $—CH_2—COOB$, q is 0, and B is hydrogen or a cation.

14. A method according to claim 1, wherein the fibrous material made of or containing wool is dyed in the presence of a wool preservative comprising the diol of the formula $$HO—CH_2—CH(OH)—CH_2Cl$$

and a homo- or copolymer based on (meth)acrylic acid or maleic acid having a molecular weight of 500 to 5,000.

15. A method according to claim 1, wherein the fibrous material made of or containing wool is dyed in the presence of a wool preservative comprising the diol of the formula $$HO—CH_2—CH(OH)—CH_2Cl$$

and an alkaline earth metal, alkali metal or ammonium salt of hydrochloric acid, sulfuric acid or phosphoric acid.

16. A method according to claim 9, wherein the wool preservative comprises $\leqq 10\%$ by weight, based on the entire formulation, of the diol of the formula $$HO—CH_2—CH(OH)—CH_2Cl$$

17. A method according to claim 1, wherein the fibrous material made of or containing wool is dyed in the presence of 0.5 to 10% by weight, on weight of fibre, of one or more compounds of the formula (I).

18. A method according to claim 1, for dyeing wool/-polyester blends by the exhaust method.

* * * * *